US007748372B2

(12) United States Patent
Harding et al.

(10) Patent No.: US 7,748,372 B2
(45) Date of Patent: Jul. 6, 2010

(54) ADAPTABLE TILE-CUTTER APPARATUS FOR RECEIVING DISPARATELY-SIZED TILES

(75) Inventors: Andrew Chase Harding, Springdale, AR (US); Troy Thurber, Bentonville, AR (US)

(73) Assignee: Marshalltown Company, Marshalltown, IA (US)

( * ) Notice: Subject to any disclaimer, the term of this patent is extended or adjusted under 35 U.S.C. 154(b) by 0 days.

(21) Appl. No.: 12/332,141

(22) Filed: Dec. 10, 2008

(65) Prior Publication Data

US 2009/0145416 A1 Jun. 11, 2009

Related U.S. Application Data

(60) Provisional application No. 61/012,843, filed on Dec. 11, 2007.

(51) Int. Cl.
*B28D 1/00* (2006.01)
*B26F 3/00* (2006.01)

(52) U.S. Cl. ..... 125/23.02; 225/96.5

(58) Field of Classification Search ..... 125/23.02; 225/96.5, 96, 94

See application file for complete search history.

(56) References Cited

U.S. PATENT DOCUMENTS

| | | | | |
|---|---|---|---|---|
| 434,782 | A | 8/1890 | Heyer | |
| 533,426 | A | 2/1895 | Bartzen | |
| 541,127 | A | 6/1895 | Smith | |
| 1,873,721 | A | 8/1932 | Postley | |
| 1,932,659 | A | 10/1933 | Granite | |
| 1,995,741 | A | 3/1935 | Granite | |
| 2,184,894 | A | 12/1939 | Mariutto | |
| 2,246,351 | A | 6/1941 | Engleke | |
| 2,289,985 | A | 7/1942 | Nastri | |
| 2,568,816 | A * | 9/1951 | Marus | 125/23.02 |
| 3,889,862 | A | 6/1975 | Insolio et al. | |
| 4,026,262 | A | 5/1977 | Yasuga | |
| 4,192,282 | A | 3/1980 | Fischer | |
| 4,693,232 | A * | 9/1987 | Yasuga | 125/23.02 |
| 4,770,156 | A | 9/1988 | Boada Sucarrats | |
| 4,774,930 | A | 10/1988 | Sellers | |
| 4,881,439 | A | 11/1989 | Biedermann | |
| 5,040,521 | A | 8/1991 | Pourtau | |
| 5,480,082 | A | 1/1996 | Yasuga | |
| 5,483,749 | A | 1/1996 | Hepworth | |
| 5,615,665 | A | 4/1997 | Thiriet | |
| 5,626,124 | A * | 5/1997 | Chen | 125/23.02 |
| 6,012,441 | A * | 1/2000 | Liu | 125/35 |

(Continued)

*Primary Examiner*—Robert Rose
(74) *Attorney, Agent, or Firm*—Keisling & Pieper PLC; Meredith K. Lowry

(57) ABSTRACT

This invention is related to an adaptable tile-cutter apparatus for scoring and breaking disparately-sized tiles. The apparatus broadly includes: a pair of end castings removably; a rigid crossbeam and a travel rail spanning the pair of end castings; vertical-adjustment mechanisms mounted to the travel rail; one or more platform assemblies each coupled to the rigid crossbeam; and a cutting mechanism slidably engaged to the travel rail. The vertical-adjustment mechanisms individually adjust a height of the travel rail with respect to the pair of end castings. In addition, the rigid crossbeam and the travel rail comprise a first matched set, and are each removably coupled to the pair of end castings. Accordingly, a second matched set that includes another rigid crossbeam and another travel rail possessing lengths at variance with the rigid crossbeam and the travel rail of the first matched set may be interchanged therewith.

19 Claims, 8 Drawing Sheets

U.S. PATENT DOCUMENTS

| | | | | |
|---|---|---|---|---|
| 6,164,272 | A | 12/2000 | Fouy | |
| 6,223,736 | B1 * | 5/2001 | Yasuga | 125/23.02 |
| 6,240,914 | B1 * | 6/2001 | Yasuga | 125/23.02 |
| 6,935,544 | B2 | 8/2005 | Torrents I Comas | |
| 6,953,036 | B2 | 10/2005 | Ishii | |
| 7,013,785 | B2 | 3/2006 | Torrents I Comas | |
| 7,047,961 | B2 | 5/2006 | Eckstein | |

* cited by examiner

ADAPTABLE TILE-CUTTER APPARATUS FOR RECEIVING DISPARATELY-SIZED TILES

CROSS-REFERENCE TO RELATED APPLICATIONS

This application claims the benefit of U.S. Provisional Application No. 60/012,843, filed Dec. 11, 2007, entitled "Adaptable Tile-cutter Apparatus for Receiving Disparately-sized Tiles," herein incorporated by reference

STATEMENT REGARDING FEDERALLY SPONSORED RESEARCH OR DEVELOPMENT

Not applicable.

BACKGROUND OF THE INVENTION

This invention relates to a tile-cutter apparatus that is adaptable for receiving disparately-sized tiles, and for scoring and breaking the disparately-sized tiles. More particularly, an improved tile-cutter apparatus including a matched set of a travel rail and a rigid crossbeam that is interchangeable with a second matched set of another travel rail and another rigid crossbeam possessing a length at variance with the first matched set is disclosed.

Tile cutters are common in the construction industry. Typically, these tile cutters have a particular configuration that is static and relates to a type of tile or material that the tile cutter is designed to cut. For instance, a particular tile cutter may be configured to receive a large travertine tile. That is, the configuration of this particular tile cutter requires a long base and a cutting mechanism suspended high above the base. However, this configuration is inconvenient, or even inoperable, when attempting to score and/or break a smaller mosaic tile. Because tile cutters cannot adapt in either length of the base or height of the cutting mechanism, those carpenters who set tile floors are forced to maintain and handle a plurality of tile cutters, each configured for a specific tile. Accordingly, present tile cutters with a static configuration are burdensome for a carpenter to store and operate (e.g., if the subject tile is not specific to the configuration of the tile cutter), and expensive to maintain and transport.

Generally, the invention relates to an adaptable tile-cutter apparatus that is adjustable in both length, by interchanging matched sets of travel rail and rigid crossbeam, and adjustable in cutting mechanism height above a subject tile, by providing vertical-adjustment mechanisms between the travel rails and rigid crossbeams.

BRIEF SUMMARY OF THE INVENTION

A brief overview of an adaptable tile-cutter apparatus and its components follows immediately below. A more detailed description is provided in the Detailed Description of the Invention section.

Generally, the present invention provides an adaptable tile-cutter apparatus (hereinafter the "apparatus") for receiving disparately-sized tiles, and for scoring and breaking the disparately-sized tiles.

The apparatus broadly includes the following components: a first end casting and a second end castings each including a set of upward-facing grooves; a rigid crossbeam, spanning the first end casting and the second end casting, that has lower longitudinal members to engage with the set of upward-facing grooves; a pair of generally mirror-image platform assemblies each coupled to one of the lower longitudinal members of the rigid crossbeam; a travel rail spanning the first end casting and the second end casting; and a cutting mechanism slidably engaged to the travel rail. In one embodiment, the first end casting and the second end casting include at least one downward-facing cavity formed therein such that one or more circular feet may be fixedly attached to the downward-facing cavities. In one instance, each of the circular feet have a convex dished portion that is positioned adjacent to an underlying surface. This allows for the apparatus to slide easily on the underlying surface so that the apparatus may be repositioned for efficient operation.

In other embodiments, the rigid crossbeam includes an upper longitudinal spine, the travel rail includes a lower edge and a pair of lateral surfaces, and the cutting mechanism includes one or more of the following: a housing that includes an integral handle, a forward portion, a rearward portion, a lower arm, and a rail-capture channel; a pair of laterally-spaced bushings inserted within the rail-capture channel; a breaker head frictionally engaged to the lower arm; a scoring tool rotatably coupled to the forward portion; and a bearing rotatably coupled to the rearward portion. Accordingly, each of the pair of laterally-spaced bushings inserted within the rail-capture channel may be in slidable communication with each of the pair of lateral surfaces of the travel rail, respectively. In operation, the cutting mechanism may be selectively moveable between a scoring position (e.g., for scoring the disparately-sized subject tiles supported by the pair of platform assemblies) and a breaking position (e.g., for breaking the disparately-sized subject tiles against the upper longitudinal spine). When selectively moved to the scoring position, the integral handle is rotated upward away from the travel rail to position the scoring tool adjacent to a subject tile and to place the bearing in rotary engagement with the lower edge of the travel rail. When selectively moved to breaking position, the integral handle is rotated downward towards the travel rail to lift the scoring tool away from a subject tile and to position opposed contact feet formed into the breaker head on the subject tile, wherein the opposed contact feet are orientated astride the upper longitudinal spine.

In an exemplary embodiment, the rigid crossbeam and the travel rail comprise a first matched set, and are each removably coupled to the first end casting and the second end casting. As such, the removable coupling provides for a second matched set (e.g., comprising another rigid crossbeam and another travel rail possessing a length at variance with the rigid crossbeam and travel rail of the first matched set) to be interchangeable with the first matched set.

In other embodiments, the first end casting and the second end casting each include an upper support with a laterally-orientated channel and a horizontal slot therein, and the travel rail includes opposed ends. In one aspect of the invention, the apparatus includes a pair of vertical-adjustment mechanisms that individually adjustably engage the first end casting and the second end casting to the travel rail at one of the opposed ends thereof. In one instance, each of the vertical-adjustment mechanisms include at least one of the following: a clevis bracket to vertically support one of the opposed ends of the travel rail; a threaded post that extends downward from the clevis bracket; and an adjustment wheel that has a threaded inside diameter to threadably engage with the threaded post, where the adjustment wheel is partially disposed within the horizontal slot.

In another aspect of the invention, the pair of generally mirror-image platform assemblies include one or more of the following: a support deck configured to provide vertical support to the disparately-sized subject tiles; a frame component that has one or more thru-holes coupled to one of the lower longitudinal members of the rigid crossbeam; and one or more tie-rod assemblies generally laterally constraining the support deck to the frame component. In one instance, each of the tie-rod assemblies are fixedly attached to the support deck and are partially disposed within the thru-holes of the frame component. In an exemplary embodiment, each of the platform assemblies further include a compression spring disposed between the frame component and the support deck. Typically, the compression spring exerts an upward bias on the support deck to provide vertical support to the disparately-sized subject tiles. In operation, when selectively moving the cutting mechanism to the breaking position, the cutting mechanism applies downward pressure to a subject tile, which is vertically supported by the support deck. Accordingly, the support deck is configured to tilt upon the downward pressure overcoming the upward bias exerted by the compression spring.

As will be seen from the detailed description that follows, the invention provides an adaptable tile-cutter apparatus for scoring and breaking disparately-sized tiles. Additional advantages, and novel features of the invention will be set forth, in part, in a description which follows and, in part, will become apparent to those skilled in the art upon examination of the following, or may be learned by practice of the invention.

BRIEF DESCRIPTION OF THE SEVERAL VIEWS OF THE DRAWING

In the accompanying drawings, which form a part of the specification, and which are to be read in conjunction therewith, and in which like reference numerals are used to indicate like parts in the various views, where thicknesses and dimensions of some components may be exaggerated for clarity.

DETAILED DESCRIPTION OF THE INVENTION

Figure 1:
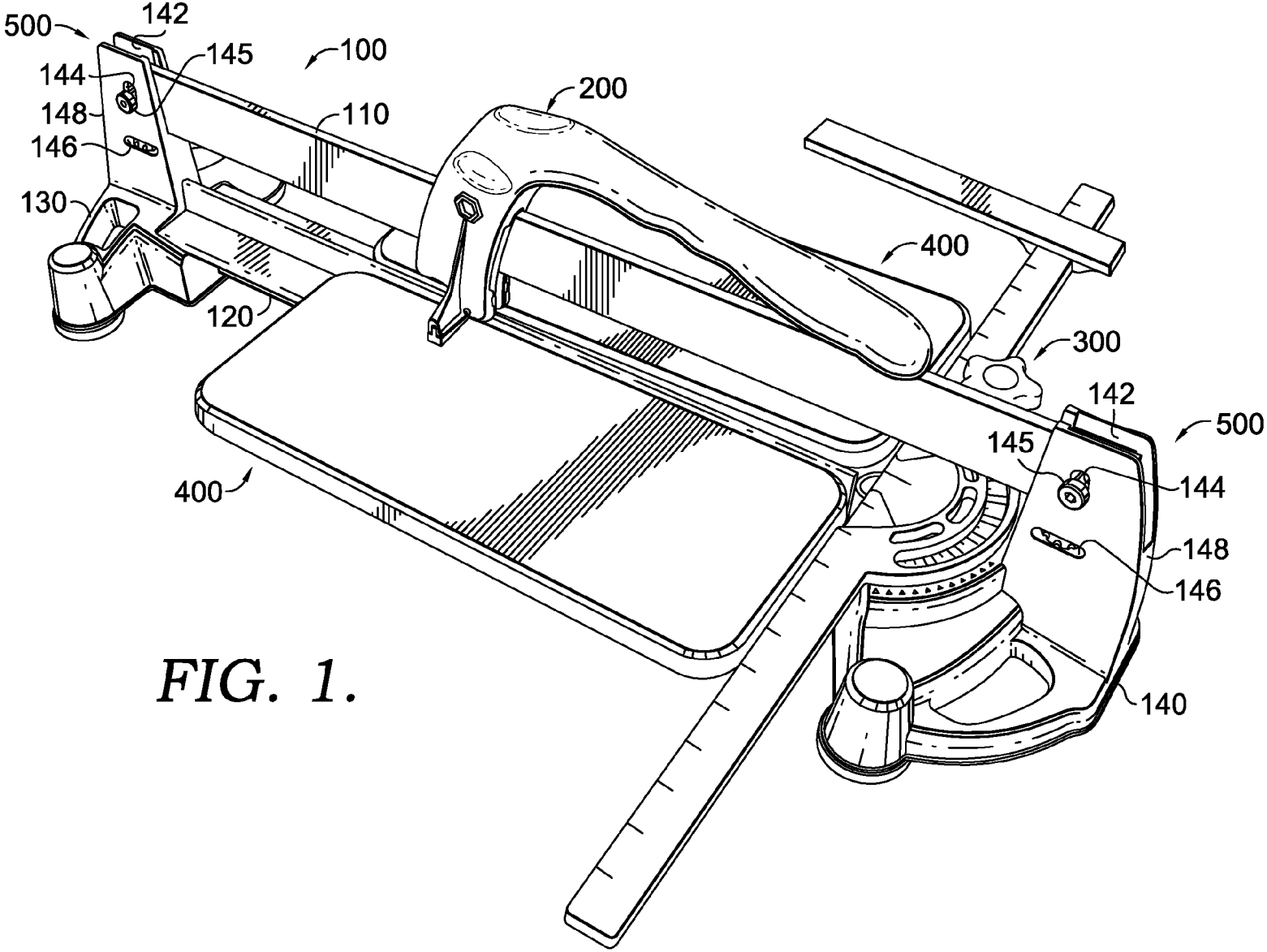
FIG. 1 is a perspective view of an adaptable tile-cutter apparatus, according to an embodiment of the present invention.

Referring to the drawings in greater detail and initially to FIG. 1, the embodiments of the present invention are directed toward an adaptable tile-cutter apparatus (hereinafter the "apparatus"), which is shown and designated generally by reference numeral 100. The apparatus 100 broadly includes, a first end casting 140, a second end casting 130, a rigid crossbeam 120 spanning the end castings 140 and 130, a pair of generally mirror-image platform assemblies 400 coupled to the rigid crossbeam 120, a travel rail 110 also spanning the end castings 140 and 130, a cutting mechanism 200 slidably engaged to the travel rail 110, a pair of vertical-adjustment mechanisms 500, and a protractor assembly 300 coupled to the first end casting 140.

In one embodiment, the end castings 140 and 130 are formed from die-cast aluminum, machined metal, or any other rigid material known by those of ordinary skill in the art. Further, the end castings 140 and 130, and any other components of the apparatus 100 discussed herein, may have a protective coating (e.g., rust-resistive material, paint, powder coat, etc.) applied thereto. In one instance, as illustrated in FIG. 1, each of the end castings 140 and 130 include an upper support 148 with a laterally-orientated channel 142, a horizontal slot 146, and a vertical slot 144 formed therein. Typically, the upper supports 148 are integral to the end castings 140 and 130; however, the upper supports 148 may be separate elements that are rigidly or adjustably attached to the end castings 140 and 130. In one instance, the laterally-orientated channels 142 may be machined, cast, or formed by any other method, into the upper supports 148 such that a portion of the travel rail 110 may be inserted therein.

Figure 3A:
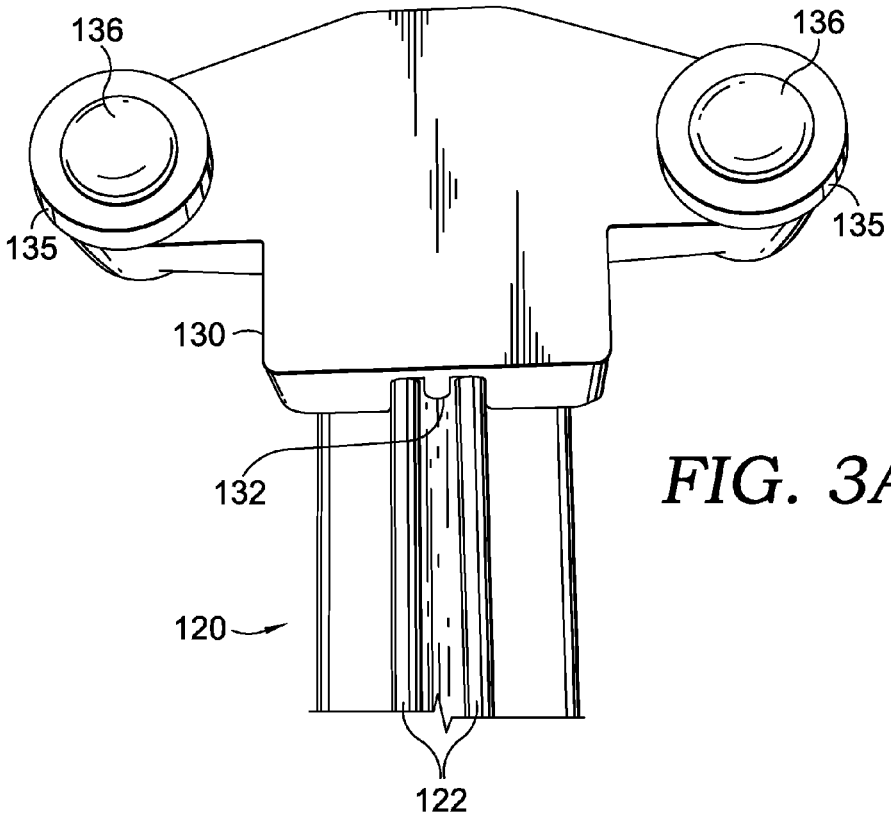
FIG. 3A is an enlarged perspective view of circular feet assembled to a second end casting, according to an embodiment of the present invention.
Figure 3B:
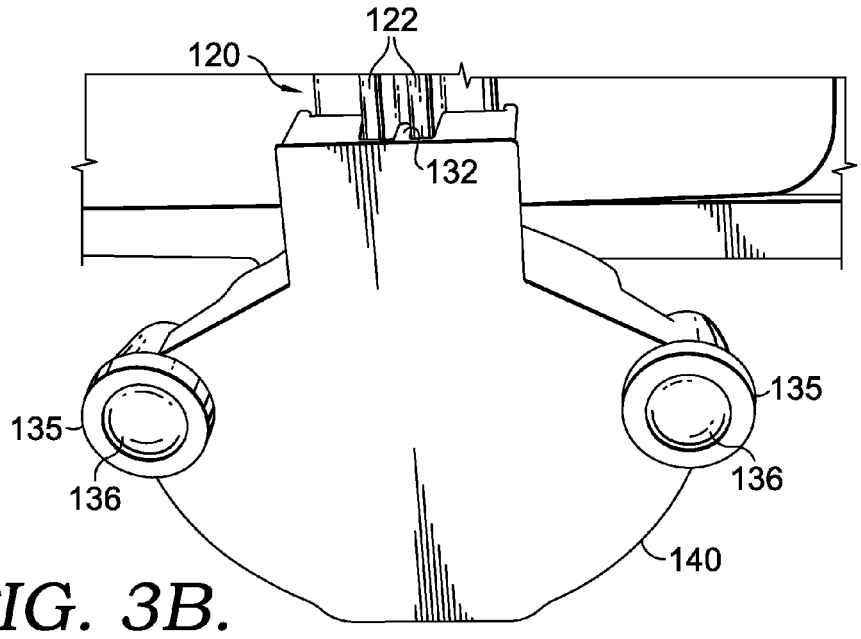
FIG. 3B is an enlarged perspective view of circular feet assembled to a first end casting, according to an embodiment of the present invention.

With reference to FIGS. 3A and 3B, the end castings may additionally include at least one downward-facing cavity (not shown) and a set of upward-facing grooves 132 formed therein, more fully discussed below. The downward-facing cavities are formed to fixedly attach to circular feet 135. By way of example, fixed attachment may be a friction-fit. In one embodiment, the circular feet 135 include convex dished portion 136. In operation, the convex dished portion 136 of the circular feet 135 is positioned adjacent to an underlying surface. This allows for the apparatus 100 to slide easily on the underlying surface so that the apparatus 100 may be repositioned for efficient operation. In one instance, the circular feet 135 are formed from a rigid material (e.g., molded polypropylene) that provides a reduced-friction contact with the underlying surface.

Figure 2:
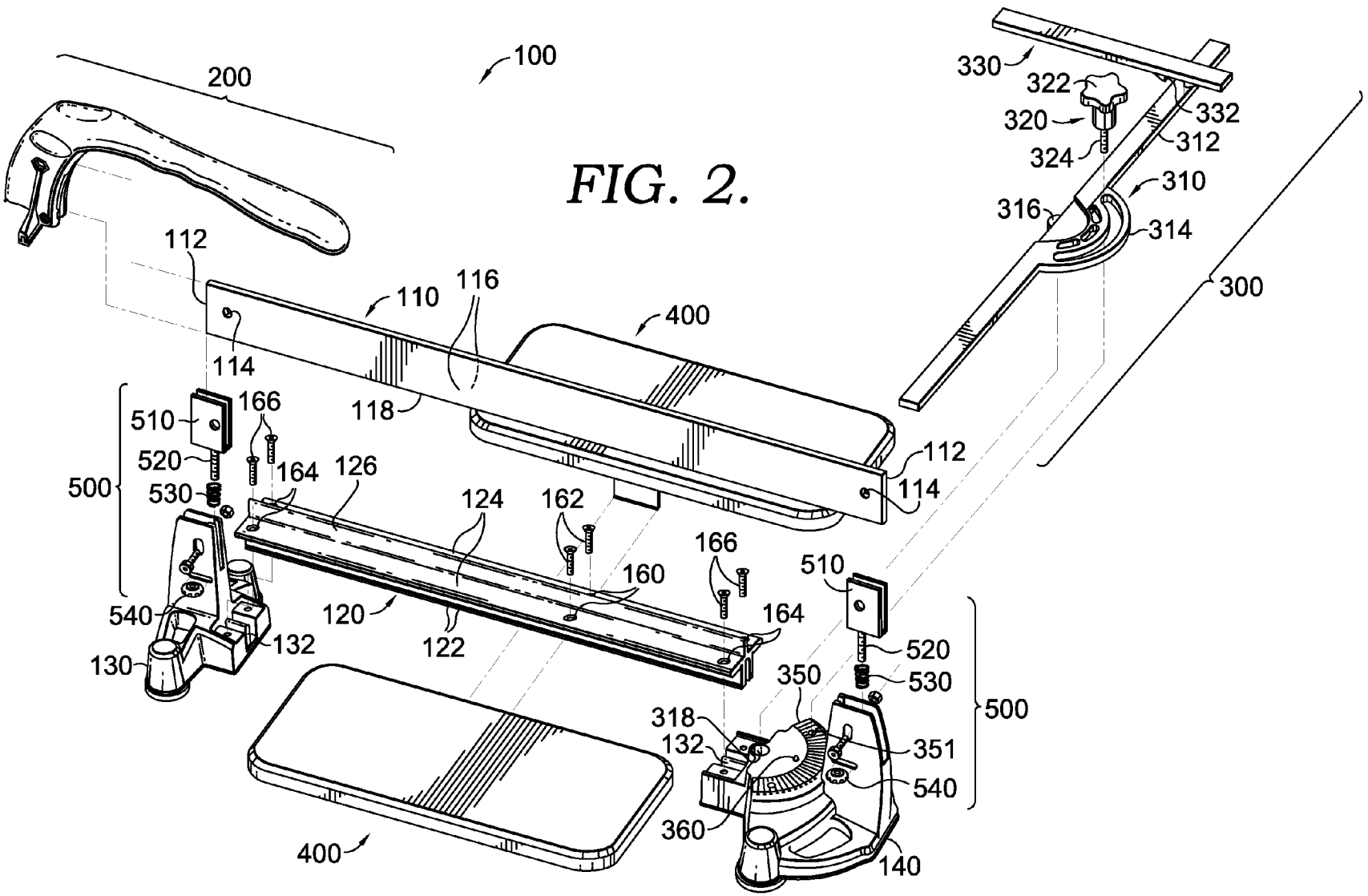
FIG. 2 is an exploded view of the adaptable tile-cutter apparatus of FIG. 1, according to an embodiment of the present invention.

Turning to FIG. 2, the pair of vertical-adjustment mechanisms 500 will now be discussed. Generally, the pair of vertical-adjustment mechanisms 500 individually adjustably engage the end castings 140 and 130 to the travel rail 110, which typically has opposed ends 112 with a bore 114 located in each of the opposed ends 112. Accordingly, the vertical-adjustment mechanisms 500 allow the travel rail 110 and the rigid crossbeam 120 to receive therebetween tiles of multiple sizes, shapes, and styles (e.g., tiles of varying thickness). Each of the pair of vertical-adjustment mechanisms 500 includes one or more of the following: a clevis bracket 510; a threaded post 520 extending downward from the clevis bracket 510; and an adjustment wheel 540. The clevis bracket 510 may be any style of fastener that can vertically support one of the opposed ends 112 of the travel rail 110. In an exemplary embodiment, the clevis bracket 510 is in the form of a yoke and captures the opposed end 112 of the travel rail 110 both laterally and vertically (e.g., at a lower edge 118 of the travel rail 110). For safety, functionality, and/or aesthetic purposes, the clevis bracket 510 may substantially disposed within the laterally-orientated channel 142 of the upper support 148 (see FIG. 1).

The threaded post 520 may be formed of any threaded element, such as a bolt, threaded rod, etc. As discussed above, the threaded post 520 is attached to the clevis bracket 510 and extends downward therefrom. The attachment is typically made by a tack weld or friction weld. Although two different configurations of the attachment have been discussed, it should be understood and appreciated by those of ordinary skill in the art that other methods of attachment could be used, and that the invention is not limited to those methods shown and described.

The adjustment wheel 540 is generally provided for allowing an operator to manually raise and lower the travel rail 110. In embodiments, the adjustment wheel 540, or thumb wheel, includes a threaded inside diameter for threadably engaging with the threaded post 520, and an outside diameter that has a grooved surface. In one instance, the adjustment wheel 540 is machined from extruded metals that has a grooved exterior. Although described and illustrated as a grooved surface, the outside diameter of the adjustment wheel 540 may be formed with any features that facilitate manual actuation (e.g., nodules, knurling, etc.).

When assembled to the threaded post 520 and one of the end castings 140 or 130, the adjustment wheel 540 is partially disposed within the horizontal slot 146 (see FIG. 1) such that a portion of the grooved surface is accessible for manual rotation by an operator. In operation, the threaded engagement of the adjustment wheel 540 with the threaded post 520 facilitates raising, lowering, or generally adjusting the travel rail 110 in relation to the upper supports 148 of the pair of end castings 140 and 130. By way of example, manual rotation of the adjustment wheel 540 in one direction upwardly vertically adjusts the travel rail 110. In another exemplary configuration, manual rotation of the adjustment wheel 540 in an alternate direction downwardly vertically adjusts the travel rail 110. This manual adjustment functionality allows the apparatus 100 to receive tiles of differing thickness under the travel rail 110. In one instance, the adjustment of the vertical-adjustment mechanisms 500 enables the cutting mechanism 200 to raise and lower between a range of 0" and ¾" above the platform assemblies 400.

In one instance, the vertical slot 144 of FIG. 1 includes an with an upper end (not shown) and is formed to receive a fastener 145 (see FIG. 1) assembled to the bore 114 at one of the opposed ends 112 of the travel rail 110. In operation, during upward vertical adjustment of the travel rail 110, contact between the fastener 145 (see FIG. 1) and the upper end of the vertical slot 144 of FIG. 1 limits the upward vertical adjustment of the travel rail 110.

In an exemplary embodiment, the vertical-adjustment mechanism 500 further includes a compression spring 530 disposed between the upper support 148 of either of the end castings 140 or 130 and the adjustment wheel 540. As such, the compression spring 530 provides an upward bias on the clevis bracket 510. This upward bias substantially removes unintended motion between the vertical-adjustment mechanisms 500 and the end castings 140 and 130. In this manner, the travel rail 110 is firmly engaged to the apparatus 100.

With continued reference to FIG. 2, the form and function of the protractor assembly 300 will now be discussed. Generally, the protractor assembly 300 is provided for capturing a subject tile during actuation of the cutting mechanism 200, thereby facilitating precisely cutting the subject tile to a particular shape. The protractor assembly 300 includes a swing bar 310, a locking device 320, and a retaining arm 330 slidably engaged to the swing bar 310. The swing bar 310 includes a fence portion 312, a radial portion 314, and a pivot pin 316 extending downward from the radial portion 314. The fence portion 312 provides a contact surface that communicates with a subject tile during operation of the apparatus 100. In some instances, the fence portion 312 has arms the extend radially from the radial portion 314 and assist in guiding the orientation of the subject tile prior to cutting. In one configuration, guiding is facilitated by providing one or more rulers on the arms of the fence portion 312. These rulers may be decals, engravings, or any other means for presenting a measuring guide.

The radial portion 312 provides for engaging the protractor assembly 300 to the first end casting 140. In one embodiment, the radial portion 312 includes a protractor pattern (not shown) formed therein. This protractor pattern typically consists of a grooved surface that engages with a detent pin 360 upwardly extending from the first end casting 140. In other embodiments, the protractor pattern engages with a complimentary raised pattern expressed on the first end casting 140. The detent pin 360 is typically a spring-loaded element that retracts during angular adjustment of the protractor assembly 300. The assembly of the pivot pin 316 and a guide slot 318 on the first end casting 140 provides a pivot for the angular adjustment of the protractor assembly 300 in relation to the cutting mechanism 200. In an exemplary embodiment, angular adjustment is confined to five-degree increments as dictated by the protractor pattern on the radial portion 314. In other embodiments, the angular adjustment may be continuous. Typically, the radial portion 314 resembles a circular arc that indicates a present angular position on a radial-measurement gauge 350 attached to, or formed in, the first end casting 140.

The locking device 320 is generally provided for compressing the detent pin 360 against protractor pattern of the radial portion 314 thereby resisting angular adjustment of the swing bar 312. Typically, the locking device 320 includes a knob portion 322, for manual actuation of the locking device 320, and a threaded portion 324 that is threadably engaged to a tapped bore 351 in the first end casting 140. In operation, an operator may rotate the locking device 320 at the knob portion 322 thereby raising and lowering the locking device 320 over the radial portion 314. When sufficiently raised, the protractor assembly 300 may angularly rotate. When sufficiently lowered, the protractor assembly 300 contacts and compresses the radial portion 314 against the first end casting 140 such that the detent pin 360 seats in the protractor pattern. In this condition, angular rotation of the protractor assembly 300 is restrained.

The retaining arm 330 acts in cooperation with the fence portion 312 to securedly capture the subject tile during actuation of the cutting mechanism 200. The retaining arm 330 is slidably engaged to the fence portion 312, and may be removable therefrom. Slidable engagement is enabled by teeth 332 on the retaining arm 330 that engage with a channel (not shown) on the fence portion 312. Further, slidable engagement typically includes movement of the retaining arm 330 along a rectilinear path defined by the fence portion 312, when the retaining arm is in an adjustment condition. In an operation condition, the retaining arm 330 is fixed to the fence portion 312 such that fence portion 312 and retaining arm act 330 in cooperation to securedly capture disparately-sized subject tiles. In one instance, switching between the adjustment condition and the fixed condition is achieved by tightening a set screw engaged to the retaining arm 330 against the fence portion 312.

As briefly mentioned above, the travel rail 110 spans between the end castings 140 and 130, and is adjustably engaged thereto. The travel rail 110 includes, but is not limited to, the following features: the opposed ends 112 with the bores 114 located at each of the opposed ends 112, respectively; the lower edge 118; and a pair of lateral surfaces 116. Typically, the travel rail 110 is formed from a rigid material (e.g., chrome-plated steel bar) that provides a bearing surface for the cutting mechanism 200. In this way, the cutting mechanism 200 traverses a portion of the travel rail 110 during actuation. In embodiments, the travel rail 110 resides in substantially parallel-spaced relation to the rigid crossbeam 120.

In general, the rigid crossbeam 120 provides an integral scoring support, breaking fulcrum, and a general structural element that spans and connects the end castings 140 and 130. Accordingly, the rigid crossbeam 120 is formed from a rigid or sturdy material (e.g., extruded aluminum). Typically, the rigid crossbeam 120 includes one or more of the following features: an upper longitudinal spine 126, lower longitudinal members 122, a pair of lateral longitudinal members 124, mounting holes 164, and a set of apertures 160 positioned on the lateral longitudinal members 124. The rigid crossbeam 120 is removably coupled to the end castings 140 and 130. In one instance, the removable coupling is made by mounting hardware 166 (e.g. flat-head socket cap screws), which assemble to the end castings 140 and 130 via the mounting holes 164. In embodiments, the mounting hardware 166 are quick-disconnect fasteners (e.g., quarter-turn quick-fasteners) that enable rapid detachment of the end castings 140 and 130 from the rigid crossbeam 120. The removable coupling may include inserting the lower longitudinal members 122 into upward-facing grooves 132 formed into both the first end casting 140 (as depicted at FIG. 3B) and the second end casting 130 (as depicted at FIG. 3A). This insertion-style of removable coupling provides enhanced structural stability that is resistive to torsion and other forces on the apparatus 100 (e.g., downward pressure from the cutting mechanism 200 when scoring or breaking a subject tile).

In an exemplary embodiment, the rigid crossbeam 120 and the travel rail 100 comprise a matched set. Accordingly, lengths of the assembled rigid crossbeam 120 and travel rail 100 determine the distance between the end castings 140 and 130. The distance is typically set based on the type and/or size of tiles that are being cut by the apparatus 100. Because, the assembled rigid crossbeam 120 and travel rail 100 are each removably coupled to the end castings 140 and 130, as more fully discussed above, this matched set may be replaced by another matched set. In one instance, the other matched set includes another rigid crossbeam and another travel rail that each possess a length that varies in comparison the assembled rigid crossbeam 120 and travel rail 110 of the original matched set. Accordingly, this feature of interchangeability allows an operator to quickly remove a matched set corresponding to a particular tile shape and install another matched set, on the same apparatus 100, that corresponds to another tile shape. Thus, the configuration of the apparatus 100 is adaptable to a variety of specific tasks (i.e., cutting different types of tiles) without necessitating additional tile cutters. By way of example only, and not limitation, matched sets, or extension kits, may set the distance between the end castings 140 and 130 at distances of 12.125" and 18.5" (e.g., for cutting a 13" tile diagonally).

With continued reference to FIG. 2, the pair of platform assemblies 400 will now be discussed. Initially, the platform assemblies 400 are coupled to the crossbeam 120. In one instance, coupling is made by attaching the platform assemblies 400 to the rigid crossbeam 120 at an aperture of the set of apertures 160 via fasteners 162. This allows the platform assemblies 400 to couple to the rigid crossbeam 120 at a variety locations (e.g., based on the type cut required for a subject tile).

Figure 4:
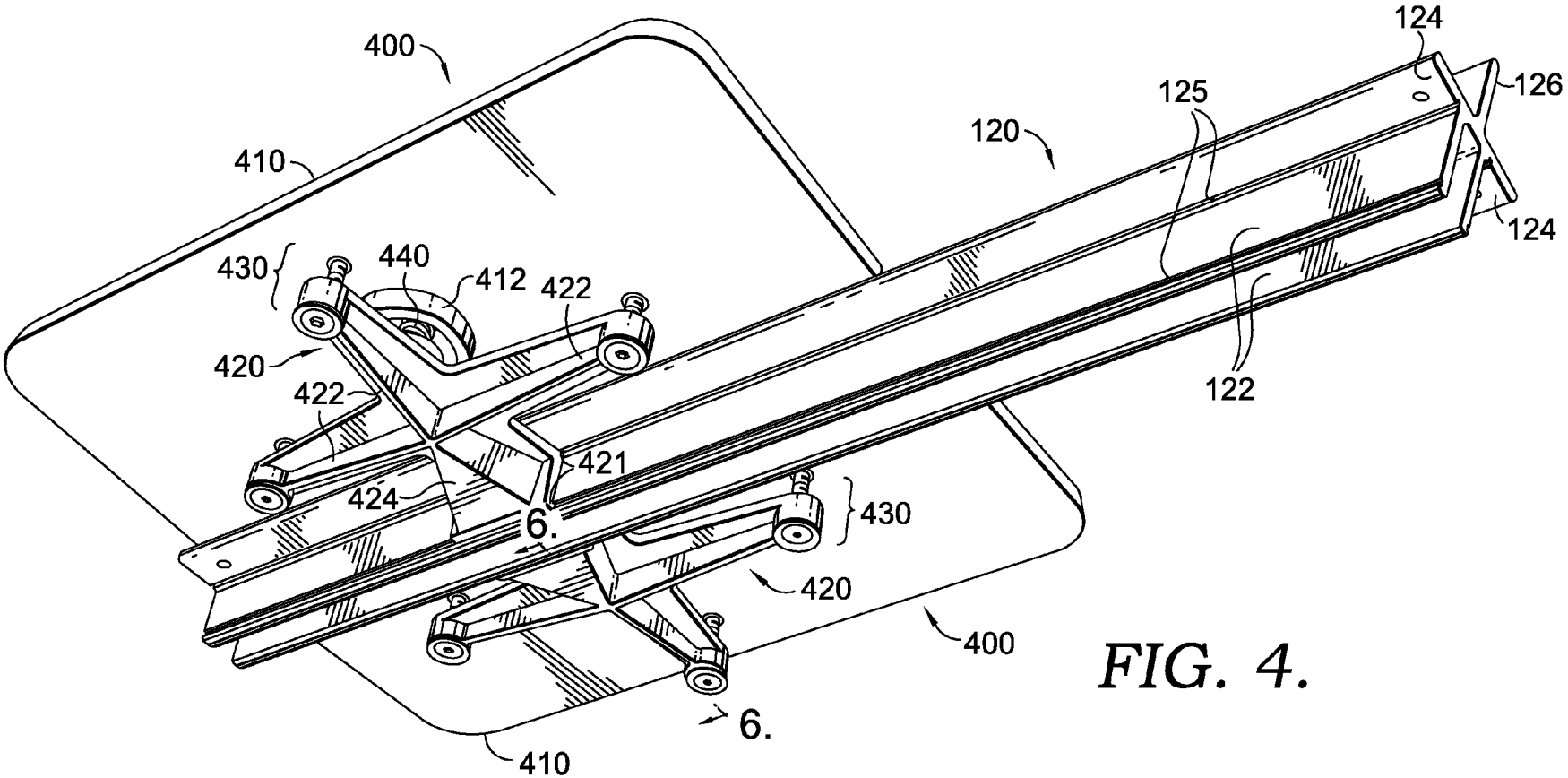
FIG. 4 is an enlarged perspective view of the adaptive tile-cutter apparatus of FIG. 1, with the first end casting, the second end casting, a travel rail, and a cutting mechanism removed for clarity, according to an embodiment of the present invention.

Turning now to FIG. 4, an enlarged perspective view of the apparatus 100 of FIG. 1, with the first end casting 140, the second end casting 130, the travel rail 110, and the cutting mechanism 200 removed for clarity is shown, according to an embodiment of the present invention. In particular, the platform assemblies 100 are shown, and the components of which will now be described with detail. Each of the platform assemblies 400 generally include a support deck 410, a frame component 420, one or more tie-rod assemblies 430 that generally laterally constraining the support deck 410 to the frame component 420, and a compression spring 440 disposed between the frame component 420 and the support deck 410. The platform assemblies 400 are generally mirror-image elements and are set apart about the upper longitudinal spine 126 of the rigid crossbeam 120.

Figure 5:
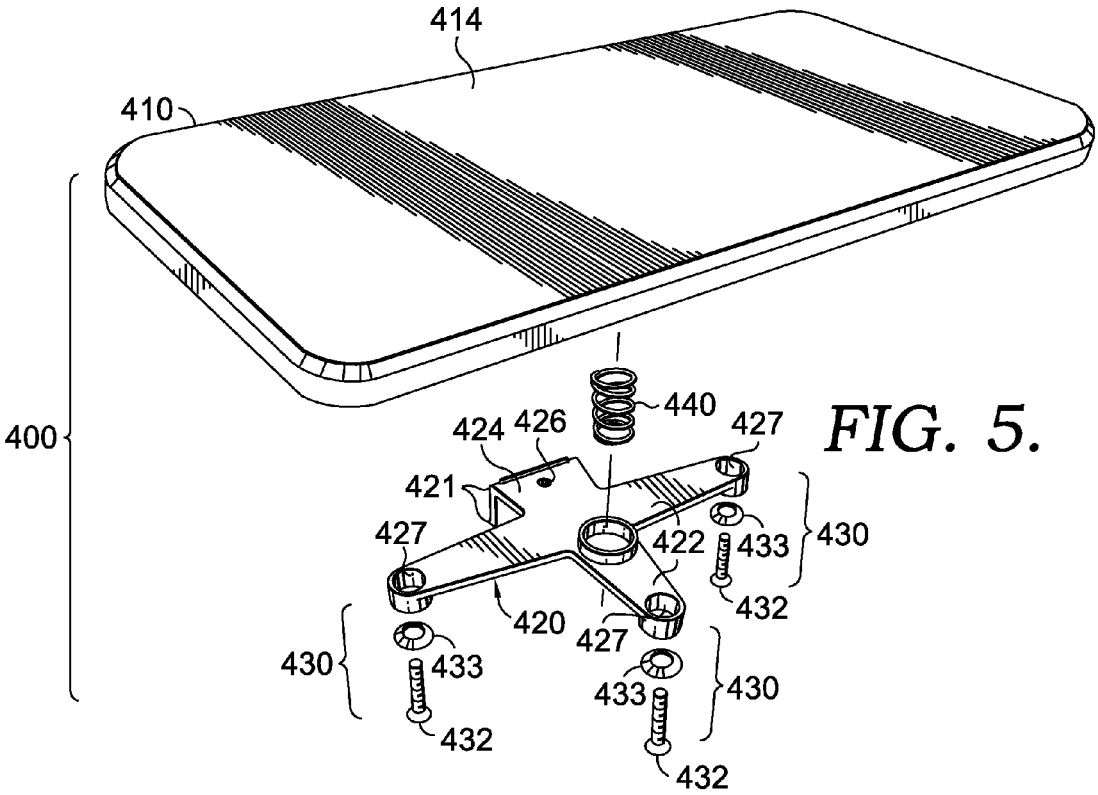
FIG. 5 is an exploded perspective view of one of a pair of generally mirror-image platform assemblies, according to an embodiment of the present invention.
Figure 6:
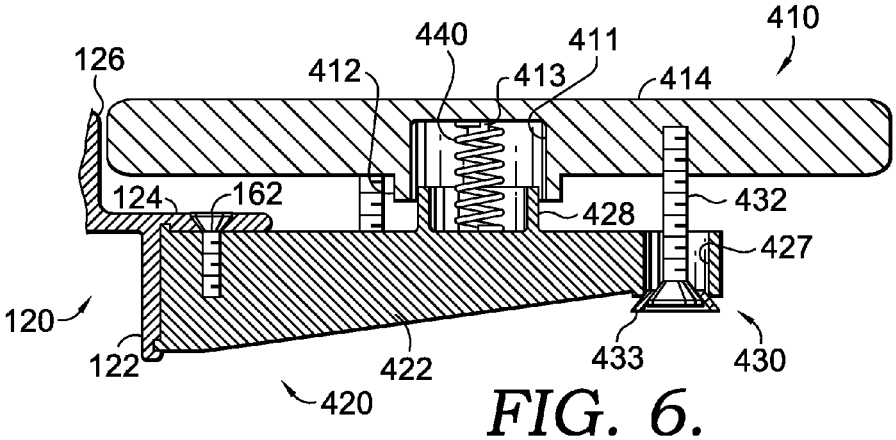
FIG. 6 is a cross-sectional view of the one of the pair of generally mirror-image platform assemblies featuring a support deck in scoring position taken along line 6-6, according to an embodiment of the present invention.

With reference to FIG. 5, an exploded perspective view is illustrated showing one of the pair of generally mirror-image platform assemblies 400, according to an embodiment of the present invention. Initially, the support deck 410 provides vertical support surface 414 that holds the disparately-sized subject tiles. Accordingly, in embodiments, support deck 410 is a rigid material particularly resistive wear (e.g., injection molded rigid glass-filled nylon). The frame component 420 generally includes radial arms 422 having one or more thru-holes 427 therein. In addition, the frame component 420 provides for coupling the platform assembly 400 to the rigid crossbeam 120 by engaging with key grooves 125 on the lower longitudinal members 122 with flanges 421, as shown in FIG. 4. Coupling also includes the frame component 420 receiving the fasteners 162 at bore 426, where the fasteners 162 are received via an aperture of the set of apertures 160, as shown in FIGS. 2 and 6. In embodiments, the frame component 420 is a rigid structure formed of a sturdy material (e.g., die-cast aluminum).

In embodiments, the tie-rod assemblies 430 include a bolt 432 and a beveled component 433 (e.g., washer). Further, the tie-rod assemblies 430 generally laterally constrain the support deck 410 to the frame component 420. In particular, as shown in FIG. 6, the tie rod assemblies 430 partially reside within the thru-holes 427 of the frame component 420 and fixedly attach to the support deck 410. As such, the rotation and tilt of the support deck 410 is limited with respect to the frame component 420 because both components are loosely connected by the tie-rod assembly 430.

The compression spring 440 will now be discussed with reference to FIG. 6, which illustrates a cross-sectional view of the one of the pair of generally mirror-image platform assemblies 400 featuring the support deck 410 in a scoring position (discussed below) taken along line 6-6, according to an embodiment of the present invention. Initially, the compression spring 440 is disposed between the frame component 420 and the support deck 440. In embodiments, the compression spring is circumferentially captured about a post 413 extending downward from the platform assembly 410 and contained by a ring element 428 integrated within the frame component 420. This embodiment retains the compression spring 440 in a substantially vertical orientation. In operation, the compression spring 440 exerts an upward bias on the support deck 410 to provide vertical support to the disparately-sized subject tiles. When the upward bias is not overcome by any downward force, the scoring position of the platform assembly 410 is attained. In the scoring position the compression spring 440 maintains the platform assembly 410 in a substantially horizontal orientation. Concurrently, the tie-rod assemblies 430 retain the platform assembly's 410 upward movement upon the beveled components 433 seating at the thru-holes 427 of the frame component 420. In an exemplary embodiment, adjustment of the fixed attachment of the bolts 432 to the platform assembly 410 affects the orientation of the platform assembly 410 in the scoring position.

When the upward bias of the compression spring 440 is overcome (e.g., by a downward pressure applied by the cutting mechanism 200), a breaking position of the platform assembly 410 is attained. In the breaking position, the platform assembly 410 moves downward and/or tilts toward the frame component 420. Concurrently, the compression spring 440 is compacted and some of the beveled components 433 are unseated from the thru-holes 427 of the frame component 420. However, although the beveled components 433 are unseated, a portion of each of the tie-rod assemblies 430 remains disposed within the thru-holes, thus, providing lateral stability to the platform assembly 410 when being displaced. The breaking position is discussed more fully with reference to FIG. 9.

Although a compression spring 440 is illustrated and described, persons familiar with the field of the invention will realize that the compression spring 440 may be practiced by various devices which are different from the specific illustrated embodiment. Therefore it is emphasized that the invention is not limited only to this above-described embodiment but is embracing of a wide variety of biasing mechanisms.

Figure 7:
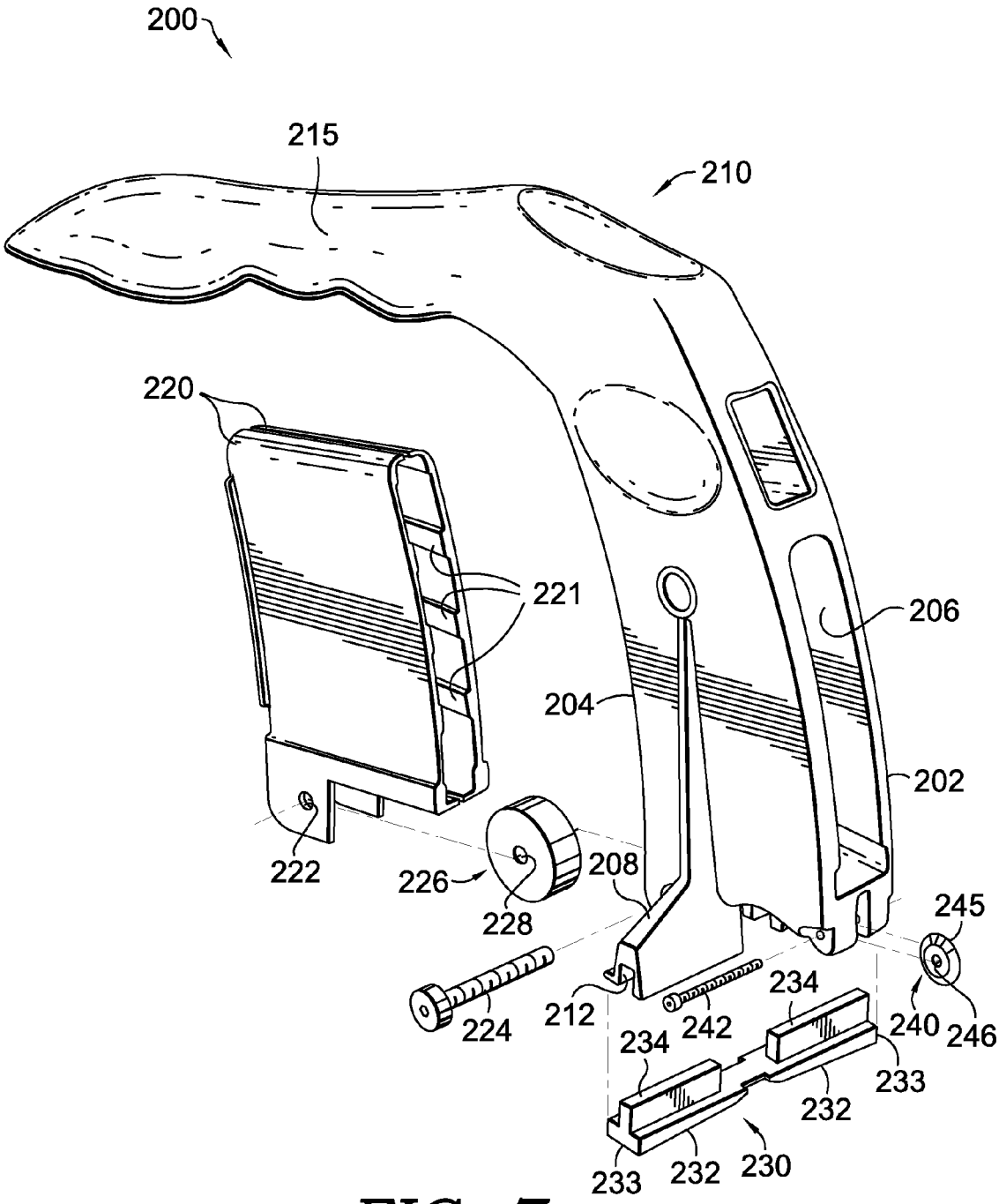
FIG. 7 is an exploded perspective view of the cutting mechanism, according to an embodiment of the present invention.

Turning now to FIG. 7, an exploded perspective view the cutting mechanism 200 is shown, according to an embodiment of the present invention. Generally, the cutting mechanism 200 is provided for scoring and breaking (e.g., pull to score, push to break) disparately-sized tiles that are received by the apparatus 100. In embodiments, the cutting mechanism 200 includes, but is not limited to, the following components: a housing 210; a pair of laterally-spaced bushings 220; a breaker head 230; a scoring tool 240; and a bearing 226. The housing 210 includes an integral handle 215, a forward portion 202, a rearward portion 204, a lower arm 208, and a rail-capture channel 206. Typically the housing 210 is formed from a rigid material (e.g., die-cast aluminum) that can withstand a large amount of torque applied thereto. The integral handle 215 extends outward from the housing 210 and is manually engaged during actuation of the apparatus 100. To facilitate engagement, the integral handle 215 may include a textured portion that is shaped to provide an operator with an ergonomic gripping surface. In other embodiments, a soft-grip cover is applied to the integral handle 215.

The pair of laterally-spaced bushings 220 are typically formed from a wear-resistive material (e.g., nylon) and are accommodated within the rail-capture channel 206 of the housing 210. As such, the laterally-spaced bushings 220 are in slidable communication with the pair of lateral surfaces 116 of the travel rail 110. This configuration protects the integrity of inner surfaces of the housing 210 when traversing the cutting mechanism 200 on the travel rail 120. Further, the laterally-spaced bushings 220 include a bore 222 and ribs 221. The bore is provided for receiving fastener 224, thereby retaining the laterally-spaced bushings 220 to the housing 210. Thus, the laterally-spaced bushings 220 are replaceable, without replacing the entire cutting mechanism 200, upon withstanding an appropriate amount of wear. The ribs 221 reduce the surface area in contact between the housing 210 and the travel rail 120; thus, the resistance when actuating the cutting mechanism 200 during scoring is also reduced.

In embodiments, the breaker head 230 includes opposed feet 232 that have outboard ends 233, and tabs 234. The breaker head 230 is typically made from a slightly malleable material, such as nylon, that may be fixedly attached to the housing 210. In one instance, the fixed attachment include press fitting the tabs 234 of the breaker head 230 into slots 212 of the lower arm 208. In operation, when in the breaking position, the outboard ends 233 of the opposed feet 232 are the first elements to contact a subject tile. Typically, the opposed feet 232 straddle the upper longitudinal spine 126 of the rigid crossbeam 120 when in breaking position.

The scoring tool 240, or cutting wheel, is typically rotatably coupled to the front portion 202 of the housing 210. The rotatable couple may include a fastener 242 that is accommodated by a bore 246 in the scoring tool 240 and is attached to the housing 210. The scoring tool 240 may also include a carbide blade 245 that is generally annular and honed to a sharp edge. The carbide blade 245 may score the subject tile, cutting a weakened line, when the cutting mechanism 200 traverses the travel rail 110 in the scoring position. During cutting, the scoring tool 240 is free to rotate about the fastener 242. As such, in an exemplary embodiment, the fastener 242 is provided with an extended shoulder thereby protecting threads from wear.

The bearing 226 is typically rotatably coupled to the rear portion 204 of the housing 210. The rotatable couple may include the fastener 224 that, in conjuncture with retaining the laterally-spaced bushings 220, is accommodated by a bore 228 in the bearing 226 and is attached to the housing 210. During cutting, the bearing 240 is positioned against the lower edge 118 of the travel rail 110 and is in rotary engagement thereto about the fastener 224. As such, in an exemplary embodiment, the fastener 224 is provided with an extended shoulder thereby protecting threads from wear.

Figure 8:
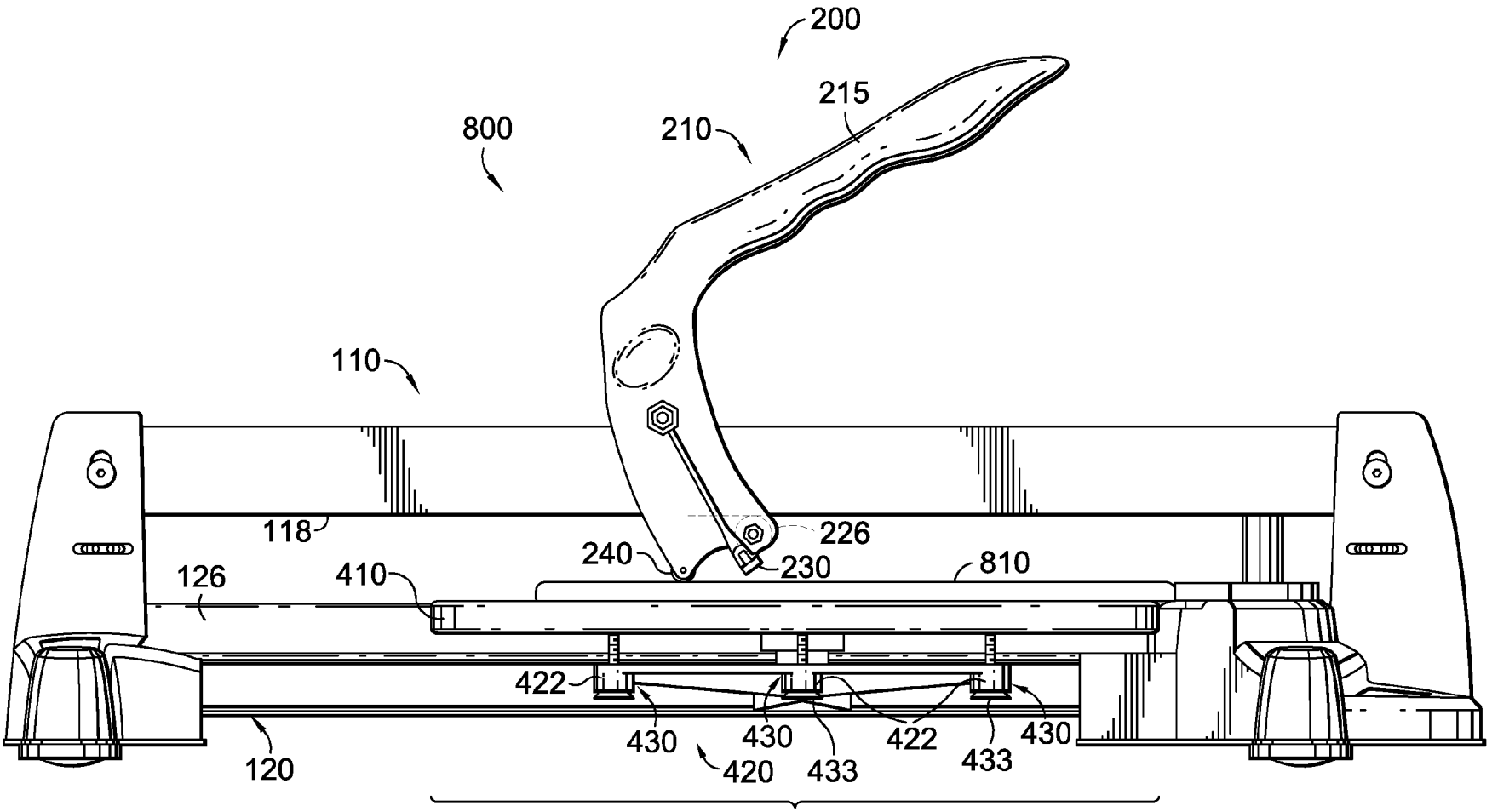
FIG. 8 is a side view of the adaptable tile-cutter apparatus featuring the cutting mechanism and the pair of platform assemblies in a scoring position, according to an embodiment of the present invention.
Figure 9:
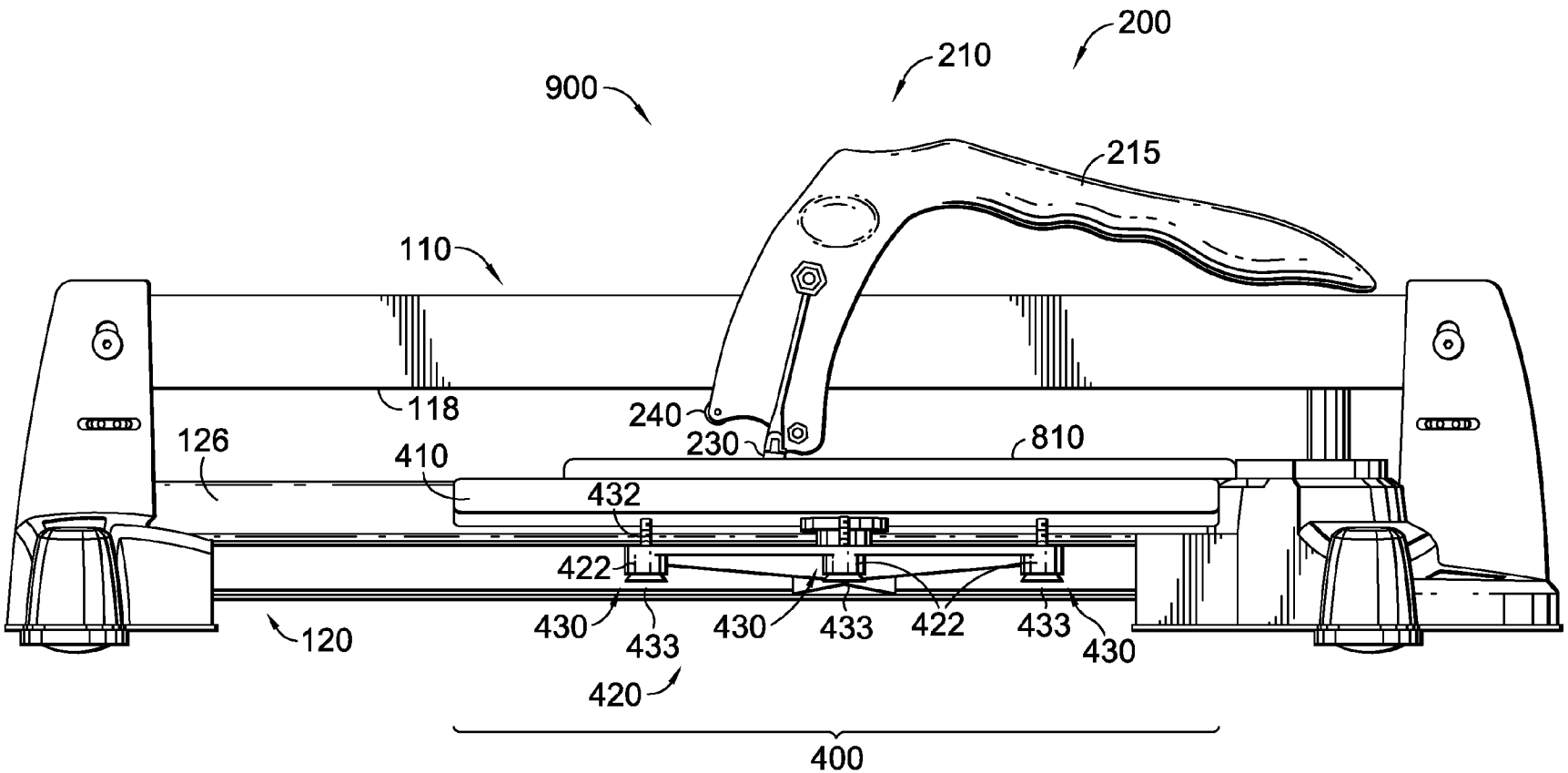
FIG. 9 is a side view of the adaptable tile-cutter apparatus featuring the cutting mechanism and the pair of platform assemblies in a breaking position, according to an embodiment of the present invention.

In operation, the cutting mechanism 200 is selectively moveable between a scoring position (see FIG. 8) and a breaking position (see FIG. 9). In scoring position, the disparately-sized subject tiles may be supported by the pair of platform assemblies 400 in a substantially horizontal orientation. In the breaking position, the disparately-sized subject tiles are pressed by the breaker head 230 against the upper longitudinal spine 126 of the rigid crossbeam while the pair of platform assemblies 400 give way.

Turning to FIG. 8, a side view is illustrated that shows the apparatus 100 featuring the cutting mechanism 200 and the pair of platform assemblies 400 in a scoring position 800, according to an embodiment of the present invention. Generally, when selectively moved to the scoring position 800, the cutting mechanism 200 is configured such that the integral handle 215 of the housing 210 is rotated upward away from the travel rail 110. Concurrently, the scoring tool 240 is positioned adjacent to a subject tile 810, thereby scoring a weaken line in the subject tile 810 upon actuation of the cutting mechanism 200 across the travel rail 110. Additionally, the selective movement places the bearing 230 in rotary engagement with the lower edge 118 of the travel rail 120.

In the scoring position 800, the upward bias generated by the compression spring 440 (see FIG. 6) is not overcome as the downward force of the scoring tool 240 is substantially directed over the upper longitudinal spine 126, not the platform assemblies 400. Accordingly, the upward bias seats the beveled components 433 against the radial arms 422 of the frame components 420; thus, positioning the support decks 410 in a substantially horizontal orientation.

With reference to FIG. 9, a side view is illustrated that shows the apparatus 100 featuring the cutting mechanism 200 and the pair of platform assemblies 400 in a breaking position 900, according to an embodiment of the present invention. Generally, when selectively moved to the breaking position 900, the cutting mechanism 200 is configured such that the integral handle 215 of the housing 210 is rotated downward toward the travel rail 110. Concurrently, the scoring tool 240 is lifted off the subject tile 810 while the break head 230 makes contact with the subject tile 810. As an operator exerts a downward force on the integral handle 215, this torque is transferred to the subject tile 810, via the breaker head 230, as a downwardly applied pressure. Because the opposed contact feet 232 (see FIG. 7) of the breaker head 230 are orientated astride the upper longitudinal spine 126, the upper longitudinal spine 126 acts a fulcrum thereby facilitating breaking the subject tile 810 along the weaken line, as discussed above.

In the breaking position 900, the upward bias generated by the compression spring 440 (see FIG. 6) is overcome as the downward pressure of the breaker head 230 is partially directed over the platform assemblies 400. Accordingly, the downward pressure unseats the beveled components 433 from a resting position against the radial arms 422 of the frame component 420. Thus, the support decks 410 move downward, or tilt, with respect to the frame component 420, thereby exposing the upper longitudinal spine 126 and facilitating breaking the subject tile 810

The breaking position 900 is relatively similar to a storage position (not shown), but the subject tile 810 is removed from the apparatus 100. In the storage position, the integral handle 215 is positioned adjacent to, or rests upon the travel rail 100; thus the integral handle 215 lays generally flat. In some embodiments of the storage position, the protractor assembly 300 is removed from the first end casting 140, as shown in FIG. 2. Accordingly, the apparatus 100 is easily transported and occupies minimal space in the storage position.

It should be understood and appreciated that the integral handle 215 may be positioned in such a manner that the scoring or the breaking action may be achieved by any movement, or combination of movements, of the integral handle 215. For instance, the integral handle 215 may be positioned in an opposed orientation to the integral handle 215 of the cutting mechanism 200 shown in FIGS. 8 and 9 (e.g., push-to-score and pull to break functionality). That is, when selectively moved to the scoring position, the integral handle 215 is rotated downward towards the travel rail 110 to position the scoring tool 240 adjacent to a subject tile 810 and to place the bearing 226 in rotary engagement with the lower edge 118 of the travel rail 110. Further, when selectively moved to breaking position, the integral handle 215 is rotated upward away from the travel rail 110 to lift the scoring tool 240 away from a subject tile 810 and to position opposed contact feet formed into the breaker head 230 on the subject tile 810, wherein the opposed contact feet are orientated astride the upper longitudinal spine 126. Although two different configurations of the cutting mechanism 200 have been described, it should be understood and appreciated by those of ordinary skill in the art that other cutting mechanisms could be used, and that the invention is not limited to those cutting mechanisms shown and described.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. An adaptable tile-cutter apparatus for scoring and breaking disparately-sized subject tiles, the apparatus comprising:

a first end casting and a second end casting;

a rigid crossbeam spanning the first end casting and the second end casting, the rigid crossbeam having an upper longitudinal spine and lower longitudinal members;

one or more platform assemblies each coupled to one of the lower longitudinal members of the rigid crossbeam;

a travel rail spanning the first end casting and the second end casting, wherein the travel rail resides in substantially parallel-spaced relation to the rigid crossbeam; and a cutting mechanism slidably engaged to the travel rail, the cutting mechanism comprising:

(1) a housing having an integral handle, a forward portion, a rearward portion, a lower arm, and a rail-capture channel;

(2) a pair of laterally-spaced bushings inserted within the rail-capture channel;

(3) a breaker head frictionally engaged to the lower arm;

(4) a scoring tool rotatably coupled to the forward portion; and (5) a bearing rotatably coupled to the rearward portion;

wherein the rigid crossbeam and the travel rail comprise a first matched set, and are each removably coupled to the first end casting and the second end casting such that at least a second matched set comprising another rigid crossbeam and another travel rail possessing a length at variance with the rigid crossbeam and travel rail of the first matched set is interchangeable with the first matched set.

2. The apparatus of claim 1, wherein the cutting mechanism is selectively moveable between a scoring position for scoring the disparately-sized subject tiles supported by the one or more platform assemblies and a breaking position for breaking the disparately-sized subject tiles against the upper longitudinal spine.

3. The apparatus of claim 2, wherein the cutting mechanism is configured such that, when selectively moved to the scoring position, the integral handle is rotated upward away from the travel rail to position the scoring tool adjacent to a subject tile and to place the bearing in rotary engagement with the travel rail, and when selectively moved to breaking position, the integral handle is rotated downward towards the travel rail to lift the scoring tool away from a subject tile and to position opposed contact feet formed into the breaker head on the subject tile, wherein the opposed contact feet are orientated astride the upper longitudinal spine.

4. The apparatus of claim 2, wherein the cutting mechanism is configured such that, when selectively moved to the scoring position, the integral handle is rotated downward towards the travel rail to position the scoring tool adjacent to a subject tile and to place the bearing in rotary engagement with the travel rail, and when selectively moved to breaking position, the integral handle is rotated upward away from the travel rail to lift the scoring tool away from a subject tile and to position opposed contact feet formed into the breaker head on the subject tile, wherein the opposed contact feet are orientated astride the upper longitudinal spine.

5. The apparatus of claim 1, wherein each of the pair of laterally-spaced bushings inserted within the rail-capture channel are in slidable communication with each of a pair of lateral surfaces of the travel rail, respectively.

6. An adjustable tile-cutter apparatus configured to receive disparately-sized subject tiles, the apparatus comprising:

a pair of end castings each having an upper support with a laterally-oriented channel and a horizontal slot therein, each of the pair of end castings is individually adjustably engaged to a travel rail; and the travel rail spanning the first end casting and the second end casting, the travel rail having opposed ends with a bore located at each of the opposed ends;

wherein the adjustable engagement of the travel rail to the pair of end castings is made by a pair of vertical-adjustment mechanisms, each of the pair of vertical-adjustment mechanisms is assembled to one of the opposed ends, respectively, of the travel rail, and adjustably engaged to the upper support of one of the pair of end castings.

7. The apparatus of claim 6, wherein each vertical-adjustment mechanism comprises:

a clevis bracket for vertically supporting one of the opposed ends of the travel rail;

a threaded post extending downward from the clevis bracket; and an adjustment wheel having a threaded inside diameter for threadably engaging with the threaded post, the adjustment wheel being partially disposed within the horizontal slot.

8. The apparatus of claim 7, wherein the clevis bracket is substantially disposed within the laterally-oriented channel.

9. The apparatus of claim 7, wherein the upper support on each of the pair of end castings includes a vertical slot with an upper end, the vertical slot being formed to receive a fastener assembled to the bore at one of the opposed ends of the travel rail.

10. The apparatus of claim 9, wherein an outside diameter of the adjustment wheel includes a grooved surface, wherein the adjustment wheel being partially disposed within the horizontal slot such that a portion of the grooved surface is accessible for manual rotation by an operator.

11. The apparatus of claim 10, wherein the threaded engagement of the adjustment wheel with the threaded post is configured such that the manual rotation of the adjustment wheel in one direction upwardly vertically adjusts the travel rail and the manual rotation of the adjustment wheel in an alternate direction downwardly vertically adjusts the travel rail.

12. The apparatus of claim 11, wherein contact between the fastener and the upper end of the vertical slot limits the upward vertical adjustment of the travel rail.

13. The apparatus of claim 7, wherein the vertical-adjustment mechanism further comprising a compression spring disposed between the upper support and the adjustment wheel, the compression spring providing an upward bias on the clevis bracket.

14. A tile-cutter apparatus for scoring and breaking disparately-sized subject tiles, the apparatus comprising:

a first end casting and a second end casting each removably coupled to a rigid crossbeam;

the rigid crossbeam spanning the first end casting and the second end casting, the rigid crossbeam including lower longitudinal members, a pair of lateral longitudinal members each having a set of apertures therein, and an upper longitudinal spine;

a one of more platform assemblies each removably coupled to the rigid crossbeam, each of the one or more platform assemblies comprising:

(1) a support deck configured to provide vertical support to the disparately-sized subject tiles;

(2) a frame component coupled to one of the lower longitudinal members of the rigid crossbeam at an aperture of the set of apertures, wherein the frame component including one or more thru-holes; and (3) one or more tie-rod assemblies generally laterally constraining the support deck to the frame component, wherein each of the one or more tie-rod assemblies are fixedly attached to the support deck and are partially disposed within the one or more thru-holes of the frame component;

a travel rail spanning the first end casting and the second end casting, and a cutting mechanism rotatably engaged to the travel rail.

15. The apparatus of claim 14, wherein each of the one or more platform assemblies further comprising a compression spring disposed between the frame component and the support deck, wherein the compression spring exerts an upward bias on the support deck to provide vertical support to the disparately-sized subject tiles.

16. The apparatus of claim 15, wherein, upon selectively moving the cutting mechanism rotatably engaged to the travel rail to a breaking position, the cutting mechanism applies downward pressure to at least one of the disparately-sized subject tiles vertically supported by the support deck, wherein the support deck is configured to tilt upon the downward pressure overcoming the upward bias exerted by the compression spring.

17. An adaptable tile-cutter apparatus for scoring and breaking disparately-sized subject tiles, the apparatus comprising:

a first end casting and a second end casting;

a rigid crossbeam spanning the first end casting and the second end casting, the rigid crossbeam having an upper longitudinal spine and lower longitudinal members;

one or more platform assemblies each removably coupled to one of the lower longitudinal members of the rigid crossbeam;

a travel rail spanning the first end casting and the second end casting;

a cutting mechanism slidably engaged to the travel rail; and a protractor assembly, the protractor assembly comprising:

(1) a swing bar having a fence portion and a radial portion with a protractor pattern formed therein, the protractor pattern engaging with a detent element extending from the first end casting;

(2) a retaining arm slidably engaged to the fence portion of the swing bar; and (3) a locking device for compressing the detent element against protractor pattern thereby resisting angular adjustment of the swing bar.

18. The apparatus of claim 17, the retaining arm being moveable along a rectilinear path defined by the fence portion in an adjustment condition and fixed to the fence portion in an operation condition such that fence portion and retaining arm act in cooperation to securedly capture the disparately-sized subject tiles.

19. The apparatus of claim 17, wherein the protractor pattern engages with a detent element such that the swing bar is angularly adjustable in relation to the cutting mechanism at five-degree increments.

* * * * *